US005544677A

United States Patent [19]

Okubo

[11] Patent Number: 5,544,677

[45] Date of Patent: Aug. 13, 1996

[54] ROBOTIC APPARATUS FOR AUTOMATIC COP CHANGING FOR A WEAVING MACHINE

[75] Inventor: Hiroyuki Okubo, Saitama-ken, Japan

[73] Assignee: Nippon Felt Co., Ltd., Tokyo, Japan

[21] Appl. No.: 341,387

[22] Filed: Nov. 17, 1994

[30] Foreign Application Priority Data

Nov. 17, 1993 [JP] Japan ..... 5-312567

[51] Int. Cl.[6] ..... D03D 45/20

[52] U.S. Cl. ..... 139/245; 901/40; 901/41; 139/224 R; 139/1 R

[58] Field of Search ..... 242/35.5 R, 35.5 A, 242/35.5 T; 901/40, 31, 41, 39; 414/902, 729, 752; 139/245, 224 R, 241, 1 R; 57/275

[56] References Cited

U.S. PATENT DOCUMENTS

| | | | |
|---|---|---|---|
| 4,486,928 | 12/1984 | Tucker et al. | 901/41 |
| 4,830,569 | 5/1989 | Jannborg | 90/41 X |
| 4,852,242 | 9/1989 | Tella et al. | 414/39 |
| 4,886,467 | 12/1989 | Peveto | 901/41 X |
| 4,897,014 | 1/1990 | Tietze | 901/41 X |
| 5,016,677 | 5/1991 | Murakami et al. . | |
| 5,211,528 | 5/1993 | Kato | 414/902 |
| 5,243,264 | 9/1993 | Takada et al. | 901/30 X |
| 5,388,879 | 2/1995 | Sekiguchi et al. | 901/40 |

FOREIGN PATENT DOCUMENTS

| | | | |
|---|---|---|---|
| 140841 | 6/1993 | Japan | 139/245 |

*Primary Examiner*—Andy Falik
*Attorney, Agent, or Firm*—Marshall & Melhorn

[57] ABSTRACT

An apparatus for replacing a cop in an automated weaving machine is provided. A single, multi-joint robot is situated near the cop replacing position of a shuttle which is reciprocated between warps. A hand stand is provided for supporting first through third hands which can be detachably mounted on the robot arm. The first hand is provided with fingers for individually handling the new cop and the new weft. The second hand includes fingers for handling the old cop and the old weft. The third hand is provided with a suction pad for engaging the shuttle with vacuum suction when transferring the shuttle, and with a hook for raising and lowering the bobbin fitted on a tong of the shuttle. The three hands allow various work steps to be carried out each in an optimum fashion without requiring additional hands to be carried by the robot arm at the same time.

15 Claims, 5 Drawing Sheets

ROBOTIC APPARATUS FOR AUTOMATIC COP CHANGING FOR A WEAVING MACHINE

TECHNICAL FIELD

The present invention relates to a cop changing device for a weaving machine, and in particular to an automated cop changing device for a weaving machine which replaces the cop adapted to be passed between warps and having a bobbin around which weft is wound.

BACKGROUND OF THE INVENTION

For instance, in a paper making machine, moisture is removed from wet fiber pulp by pressing it between a pair of opposing rollers, and the surface of such rollers consists of press felt in the form of a relatively broad endless belt. The press felt is made by entangling the fibers of a pad consisting of a plurality of layers of web with ground fabric by needling.

During the weaving process for ground fabric, the warps are set on a warp beam and fed continuously while the weft is supplied by a cop mounted on a shuttle. Therefore, when weaving a relatively broad ground fabric for making press felt, the cop needs to be replaced every time the shuttle has reciprocated a certain number of times through the warps. At the same time, the weft of the old cop needs to be tied, for instance by welding, to the weft of the next cop.

As an automated device for replacing the cop and tying the wefts, there is the one disclosed in the U.S. Pat. No. 5,016,677 (issued May 21, 1991) assigned to the common assignee. The cop changing device includes a shuttle box on each side of the array of warps, a hammer or picking device for transferring a shuttle between the shuttle boxes through a gap between the warps is, a unit for pulling out the shuttle from the shuttle receiving chamber of the shuttle box when replacing the cop, and a robot arm which pulls out the old weft from the old cop and the new weft from the new cop one after the other to a weft tying unit. The robot arm is provided with three distinct hands which are selectively operated according to control commands to replace the old cop with the new cop.

In this device, the bobbin is detachably mounted on the shuttle by being fitted on a tong which can be raised and laid in a-selective manner. When replacing the cop, the shuttle is first of all fixed at a prescribed location, and the bobbin of the old cop is raised and is removed from the tong by the cop clamping hand. Then, a new cop is picked up from a bobbin bin and fitted on a raised tong with the cop clamping hand. The new cop is retracted and mounted into the shuttle so that the weaving process may be resumed.

However, according to this device, the hands for various functions are mounted on a common multi-function arm, and it was therefore difficult to add any hands for new functions to the robot arm. A number of similar functions may be performed by a same hand, but the hand may not be designed to operate in an optimum fashion for each of the functions.

BRIEF SUMMARY OF THE INVENTION

In view of such problems of the prior art, a primary object of the present invention is to provide an improved cop changing device for a weaving machine which can carry out a number of different work steps involved in changing a cop in a reliable fashion.

A second object of the present invention is to provide an automated cop changing device which can perform each of the functions required in replacing a cop in an optimum fashion.

A third object of the present invention is to provide an automated cop changing device which does not need to carry a large number of hands on a robot arm at the same time, and is therefore capable of brisk movement without increasing the power of the actuator for the robot arm.

A fourth object of the present invention is to provide an automated cop changing device which can be fabricated and operated at minimal cost.

These and other objects of the present invention can be accomplished by providing a cop changing device for a weaving machine in which a shuttle carrying a cop consisting of a bobbin around which weft is wound is reciprocated between warps so as to weave the weft between the warps, comprising: a robot having a robot arm which can be moved within a certain area; a plurality of hands adapted to be interchangeably mounted on the robot arm for carrying out different work steps involved in changing a cop; and a hand stand for supporting the hands so that each selected one of the hands may be mounted on the robot arm by moving and engaging the robot arm to the selected hand.

Thus, by preparing a plurality of hands which are adapted to different work steps for changing a cop and to be interchangeably attached to the robot arm, and appropriately mounting each one of the hands on the robot arm for each different work step such as handling the weft and changing the cop, each of the work steps can be accomplished in an optimum fashion simply by changing the hands for different work steps. Also, the robot arm is not required to be encumbered by a large number of hands being mounted thereon at the same time.

One of the hands may comprise bobbin clamping fingers for clamping a head portion of the bobbin in a radially inward direction when replacing the cop, and a bobbin head holding finger for holding a part of the bobbin displaced from the head portion at which the bobbin is clamped by the bobbin clamping fingers to control movement of the head portion of the bobbin in cooperation with the bobbin clamping finger when the cop is being transferred from one location to another. By thus holding the bobbin or the cop at three points, the cop can be held by the hand in a stable fashion without requiring any excessive clamping force which would not only require a large power source but create the problem of possibly damaging the cop. Preferably, the bobbin head holding finger is provided with a cap member adapted to be fitted on a free end of the bobbin.

For moving the shuttle between a shuttle box and a position for replacing the cop carried therein, one of the hands may be provided with a suction pad that can be coupled with the shuttle by vacuum suction. The shuttle may be provided with a tong pivotally attached thereto for fitting the cop thereon, and one of the hands may be provided with a substantially annular member adapted to be fitted on a free end of the cop for raising and lowering the cop as fitted on the tong around a point of pivotal attachment between the tong and the shuttle.

According to a preferred embodiment of the present invention, the hands include an old weft gripping hand for pulling a weft from the old cop, and a new weft gripping hand for pulling a weft from the new cop, and a gripping force of the old weft gripping hand is small than that of the new weft gripping hand. Because the old weft is going to be woven into the finally woven fabric, it is desirable to grip it with a light force so as not to damage it. Because the old weft is connected to the woven fabric, the possibility of the old weft slipping off from the gripping fingers is not significant. On the other hand, because the gripped part of the new weft is going to be trimmed off after the old and new wefts are tied together, and it is desirable to grip the new weft without fail, the relatively large gripping force of the new weft gripping hand is both acceptable and desirable.

The coupling between the robot arm and each of the hands can be accomplished in a number of ways, and, for instance, the structure used in a machining center for changing the tool can be favorably applied to the present invention. The hand stand may comprise a horizontal tongue, and one of the hands may be provided with a slot for receiving the tongue for supporting the hand on the hand stand.

To ensure reliable operation of the cop changing device, the shuttle may be provided with a tong pivotally attached thereto for fitting the cop thereon, and one of the hands may comprise a force sensor for detecting a force applied to the hand for detecting a failure to fit the cop onto the tong according to an output from the force sensor. Should the robot arm fail to fit the cop onto the tong, new attempts may be made after slightly shifting the position of the robot arm relative to the tong until a proper fit is achieved.

To the end of accomplishing the tying operation for the old and new wefts in a stable and reliable fashion, the old and new cops may be placed on cop stands during the weft tying operation. Each of the cop stands may comprise a cup shaped support for supporting a bottom end of the cop, and a bobbin head holder for resiliently pushing an upper end of the cop in such a manner to allow the cop to freely rotate.

BRIEF DESCRIPTION OF THE DRAWINGS

Now the present invention is described in the following with reference to the appended drawings, in which.

DETAILED DESCRIPTION OF THE PREFERRED EMBODIMENT

Figure 1:
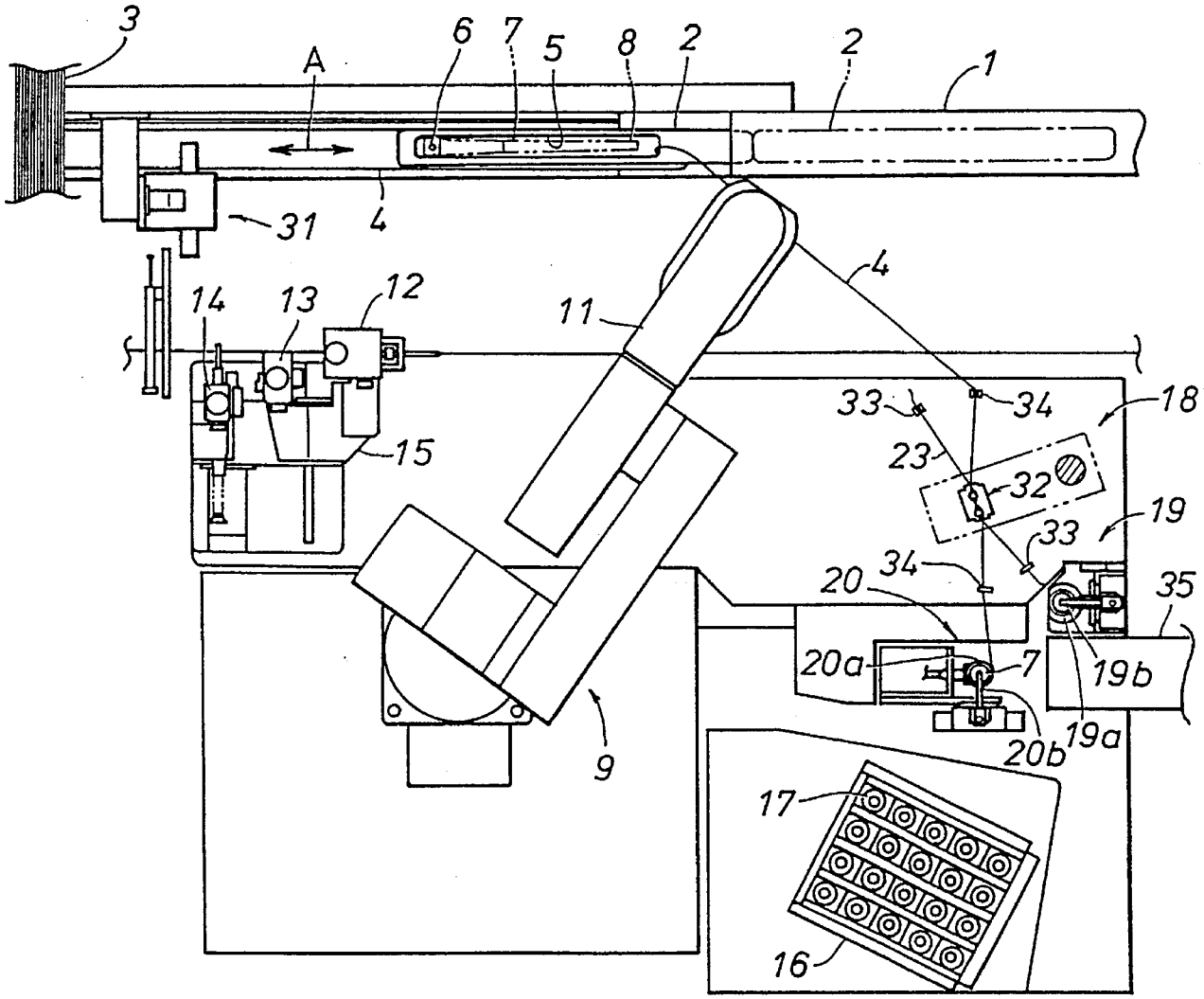
FIG. 1 is an overall plan view of the automatic cop replacing device for a weaving machine according to the present invention.

FIG. 1 illustrates an embodiment of the cop changing device according to the present invention intended for weaving ground fabric for paper making press felt. In FIG. 1, the ground fabric is woven in an area located to the left of what is shown in the drawing, and is worked from the bottom end of the drawing. A shuttle box 1 is placed at a right hand side of the drawing, and another shuttle box not shown in the drawing is placed to the left of the ground fabric so that the two shuttle boxes oppose each other across the ground fabric. In this weaving machine, a plurality of shuttles 2 are used for weaving the ground fabric, and each of the shuttles 2 is shot out in turn from one of a plurality of shuttle chambers placed one above the other inside the shuttle box 1 by a hammering or picking unit not shown in the drawing, and is shot back from the opposing shuttle box.

Each of the shuttles reciprocates between warps 3 in the direction indicated by arrow A, and the wefts 4 are woven between the warps 3 by using a reed and a weaving machine (for engaging the warp of the reed) not shown in the drawing. Each of the shuttle boxes 1 is provided with a braking device for the shuttles 2. In this embodiment, the changing of the cops is carried out at the side of the shuttle box 1 on the right hand side of the drawing.

A middle part of each shuttle 2 is provided with a slot 5 having an open upper end and extending in the longitudinal direction, and a tong 6 is pivotably attached to a longitudinal end of the shuttle 2 so as to be tiltable between a retracted position at which the tong 6 lies flat inside the slot 5 and an upright position. A bobbin 8 for forming a cop 7 by having a weft wound 4 around it is provided with an axial bore (not shown in the drawing) which opens out at a longitudinal end of the bobbin 8, and can be removably fitted onto the tong 6 from this longitudinal open end of the axial bore so as to be retained in this position. When the shuttle 2 is being shot, the cop 7 is received flat in the slot 5 of the shuttle 2 as shown in FIG. 1, and the weft 4 is paid out from a shuttle eye provided on one side of the shuttle 2.

In this device, when the shuttle 2 has reciprocated a certain number of times, and the weft 4 wound on the cop 7 has been consumed by more than a prescribed amount, the old cop 7 is replaced by a new one. When replacing the cop 7, the shuttle 2 carrying the cop 2 to be replaced is held stationary in the shuttle box 1 by using the braking device not shown in the drawing, and is then pulled out to a cop replacing position as shown in FIG. 1 so as to be replaced by a new one.

In this device, a series of work steps involved in changing the cop are automatically carried out by a robot, and the structure of this robot is now described in the following.

As shown in FIG. 1, a multi-joint robot 9 such as a revolute robot is placed in front of the shuttle 2 which has been placed at the cop replacing position. This robot 9 for instance has six axes of articulation, and can carry any one of three hands 12 to 14 in an interchangeable fashion in this embodiment. These hands, when not in use, are supported by a hand stand 15 placed at a prescribed position within a possible range of movement of a robot arm 11 as shown in FIG. 1.

A cop stocker 16 is placed at a position opposing the hand stand 15 from the other side of the robot 9 for storing new cops 17. This cop stocker 16 is provided with a plurality of upright support pins in a four by five arrangement, and can thus store twenty new cops 17 in upright orientation. It is possible to store cops of one kind in the first two rows and cops of another kind in the next two rows, and an unmanned operation of a long time duration can be accomplished by providing a plurality of cop stockers 16 in parallel arrangement and providing a larger number of different kinds of wefts and a larger amount of wefts. A welding machine 18 is placed between the cop stocker 16 and the shuttle box 1 for tying the wefts of the new and old cops at the side of the shuttle box 1, and cop stands 19 and 20 for new and old cops are provided adjacent to the cop stocker 16.

Figure 2:
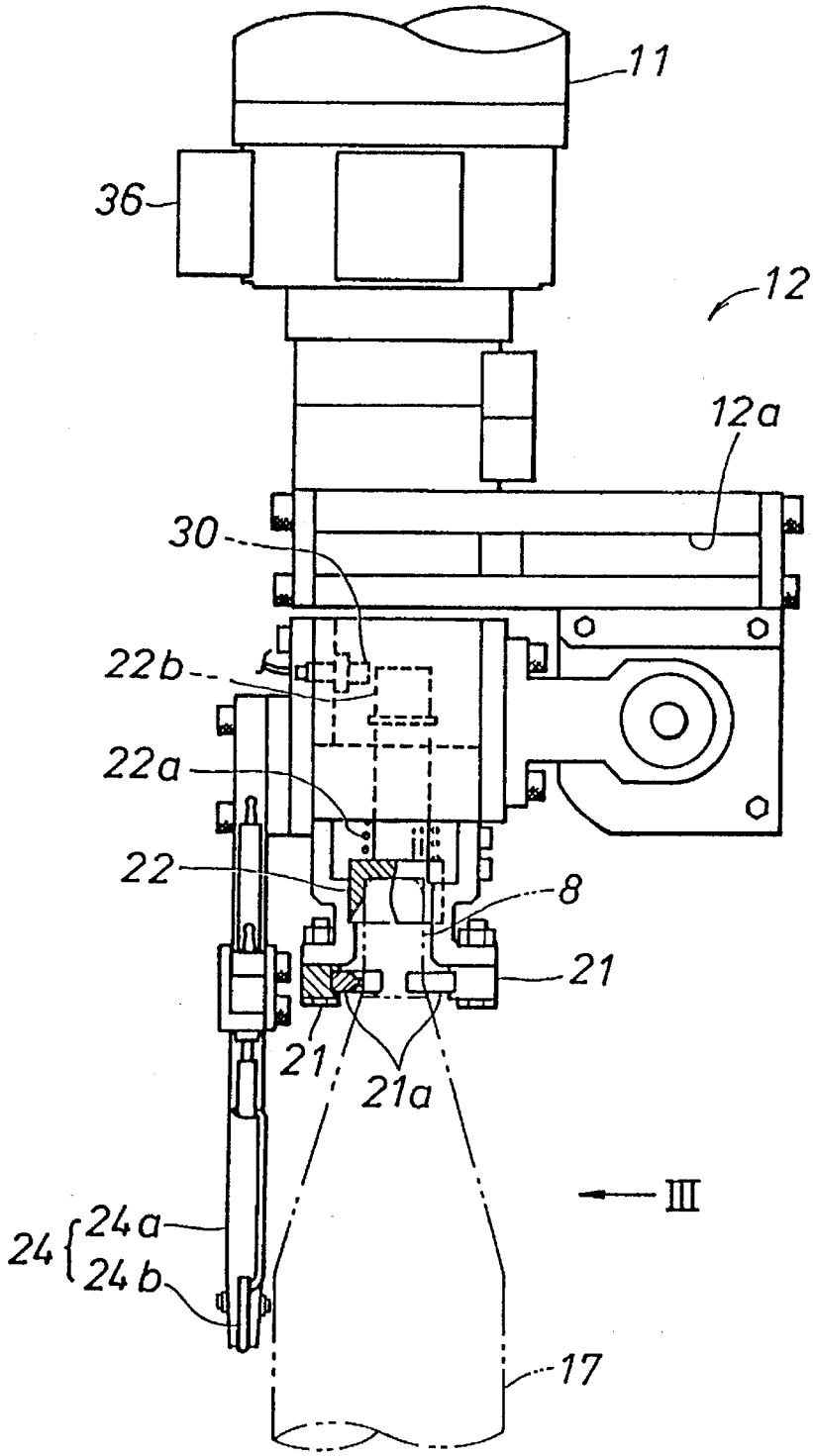
FIG. 2 is a fragmentary enlarged view of an essential part of the first hand according to the present invention.

The first hand. 12 is for handling the new cops 17 stored in the cop stocker 16. Referring to FIG. 2, the first hand 12 comprises a pair of bobbin clamping fingers 21 which can be opened and closed by an air cylinder for selectively gripping a head portion of the bobbin 8 by radially inwardly closing upon it, a bobbin holding cap 22 serving as a bobbin holding finger which can be located above the bobbin 8 when it is gripped by the bobbin clamping fingers 21 and move axially for supporting the bobbin 8 at three points in cooperation with the bobbin clamping fingers 21, and a new weft gripping fingers 24 for gripping the new weft 23 drawn out from the new cop 17.

The bobbin clamping fingers 21 are provided with V-shaped claws 21*a* in mutually opposing relationship as shown in FIG. 2, and can open and close the gap between the two V-shaped claws 21*a* at will. The free end of each of the claws 21*a* may be either sharply pointed or provided with a certain thickness depending on each particular application.

The bobbin holding cap 22 may have the shape of an inverted shallow cup, and its inner diameter is so dimensioned that there is substantially no play when it is fitted on the head portion of the bobbin 8. This cap 22 is biased by a compression coil spring 22*a* so as to resiliently urge the top portion of the bobbin 8 from above. The inner surface of the peripheral wall of the bobbin holding cap 22 is provided with an internal taper so that the bobbin holding cap 22 may be fitted onto the top portion of the bobbin 8 with ease.

Figure 3:
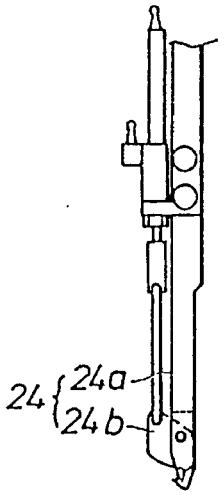
FIG. 3 is a fragmentary view of a part of FIG. 2 seen from arrow III.

The new weft gripping fingers 24 comprise a rod-shaped fixed finger 24*a* extending on one side of the fingers 21 and 24, and a moveable finger 24*b* pivotably attached to the fixed finger 24*a* so as to be received in a slot defined in a part of the fixed finger 24*a* adjacent to a free end thereof and to be rotatable therein as shown in FIG. 3. This moveable finger 24*b* is actuated by an air cylinder provided in the first hand 12, and can fairly firmly grip the new weft 23 between the claws of the two fingers 24*a* and 24*b*.

Figure 4:
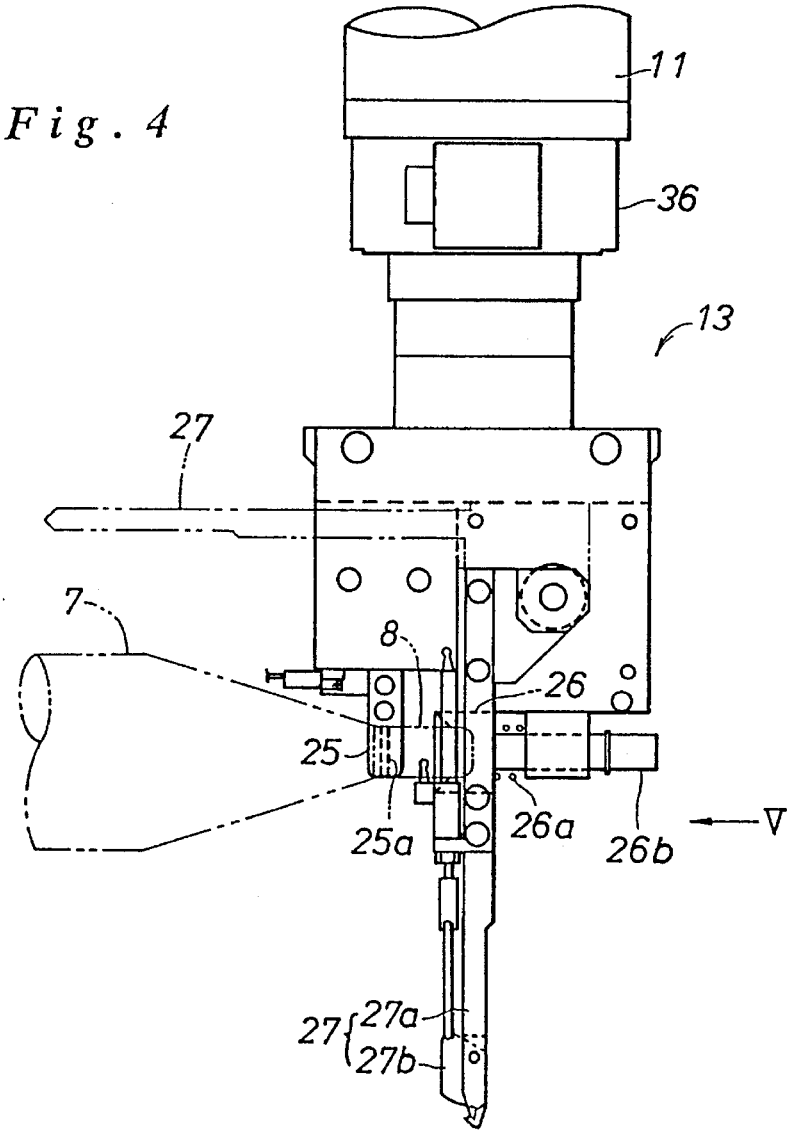
FIG. 4 is a fragmentary enlarged view of an essential part of the second hand according to the present invention.
Figure 5:
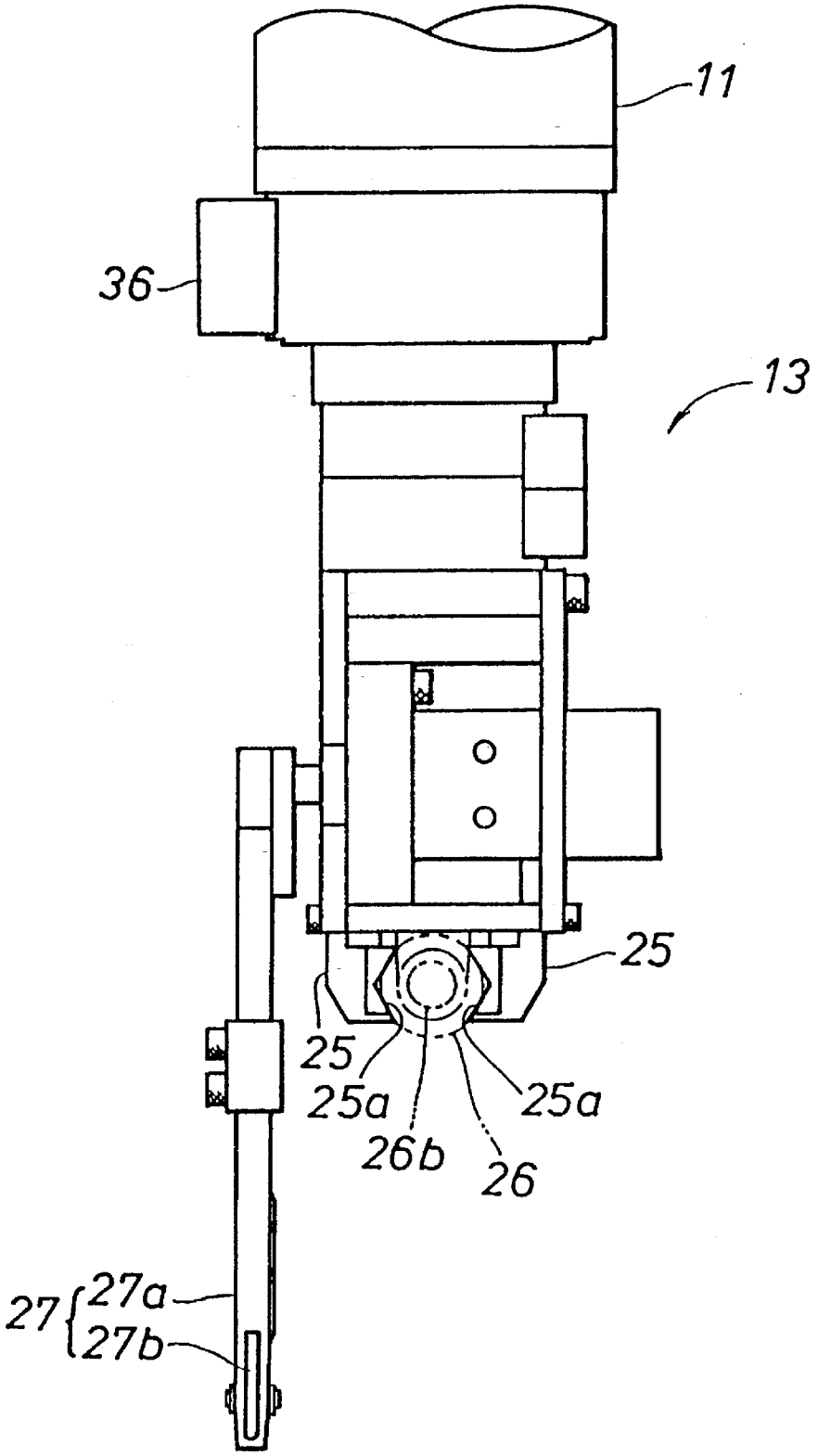
FIG. 5 is a fragmentary view of a part of FIG. 4 seen from arrow V.

The second hand 13 is designed to handle the old cop 7 from which the weft 4 has been consumed by more than a prescribed amount. As illustrated in FIGS. 4 and 5, the second hand 13 is provided with a pair of bobbin clamping fingers 25 which are opened and closed by an air cylinder so as to clamp a head portion of the bobbin 8 in a radially inward direction, a bobbin holding cap 26 for supporting the bobbin 8 at three points in cooperation with the bobbin clamping fingers 25 in a similar fashion as with the first hand 12.

These bobbin clamping fingers 25 are likewise provided with V-shaped claws 25*a* opposing each other, and can be actuated so that the gap between the two V-shaped portions may be closed and opened at will. The free end of each of the claws 25*a* may have any one of a number of possible shapes in the same was as with the first hand 12. The wooden cop head holding cap 26 may be similar to the counterpart provided in the first hand 12, and may also be resiliently biased by a compression coil spring 26*a*.

The old weft gripping fingers 27 are comprised of a rod-shaped fixed finger 27*a*, and a moveable finger 27*b* pivotably attached to the fixed finger 27*a* in the same way as with the first hand 12, and the moveable finger 27*b* can be actuated by an air cylinder provided on the second hand 13 so as to grip the old weft 4 between the claws of the two fingers 27*a* and 27*b* by cooperation of these two finger 27*a* and 27*b*. In this embodiment, the radius of rotation of the moveable finger 27*b* is somewhat larger than the radius of rotation of the moveable finger 24*b* of the new weft gripping fingers 24. This is to ensure the old weft to be gripped by each first try even when there is a certain amount of fluctuation in the position of the old weft. The weft gripping force of the two fingers 27*a* and 27*b* is selected to be less than that of the two fingers 24*a* and 24*b* of the new weft gripping fingers 24 even though identical pencil-type air cylinders are used for these fingers. By thus controlling the gripping force for the old weft, and allowing a certain amount of slippage to occur, the old weft is prevented from being damaged by the old weft gripping fingers 27. The part of the new weft that is gripped by the corresponding fingers is trimmed off after welding, but the gripped part of the old weft remains in the woven ground fabric. Therefore, any damage to the old weft must be avoided by all means. In case of the new weft, because the weft has to be gripped at a portion adjacent to a terminal end thereof, there is a possibility that the weft may slip off from the fingers if the gripping force is insufficient. However, in case of the old weft, because the weft is connected to the ground fabric on one end of the portion gripped by the fingers, and to the old cop on the other end thereof, the weft would not slip off from the finger.

Figure 6:
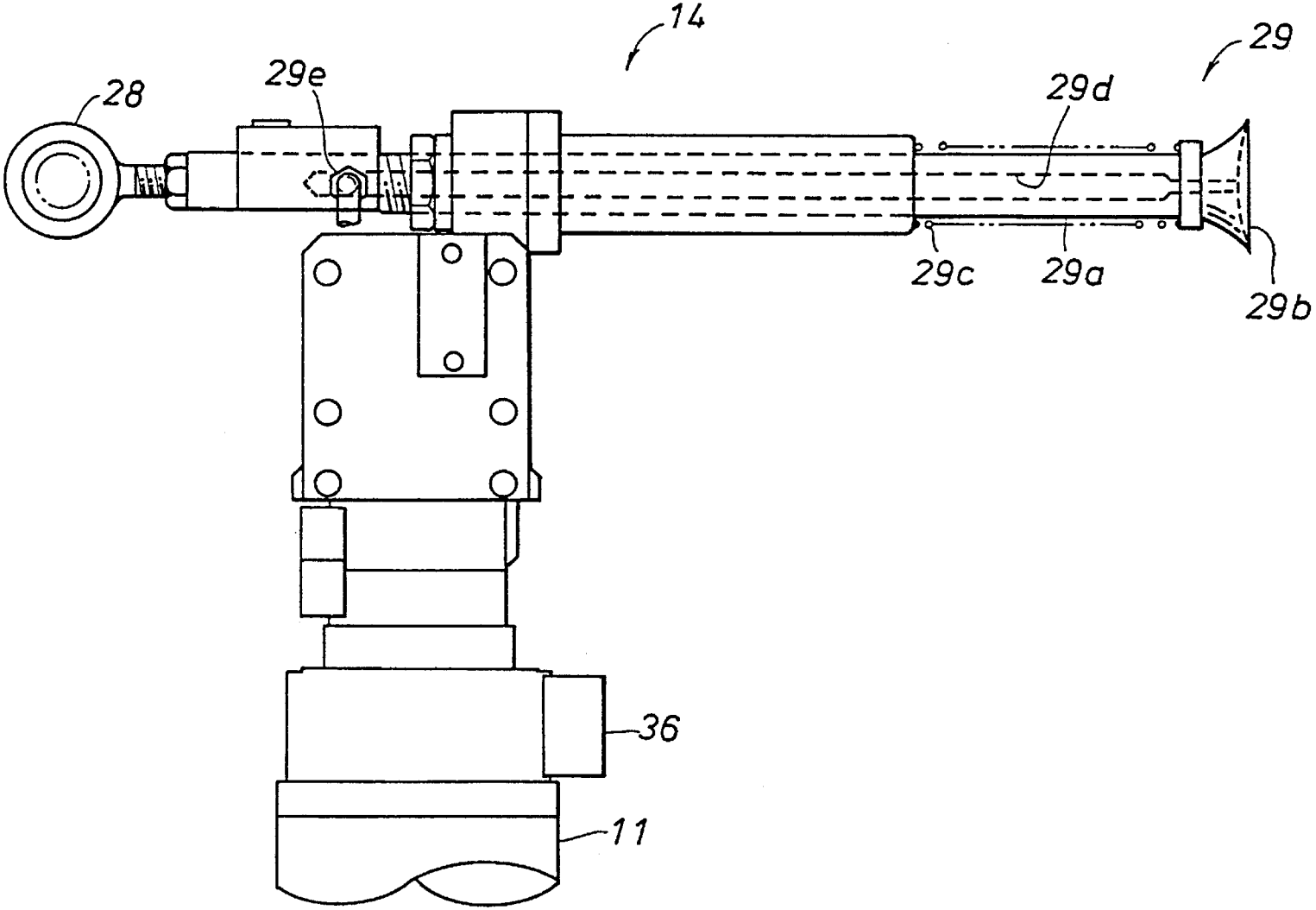
FIG. 6 is a fragmentary enlarged view of an essential part of the third hand according to the present invention.

The third hand 14 is used for raising and lowering the bobbin 8 with respect to the shuttle 2, and for drawing and pushing the shuttle 2 out of and into the shuttle box 1. As illustrated in FIG. 6, the third hand 14 is provided with an annular hook 28 adapted to be fitted on a head portion of the bobbin 8 with a certain amount of play for raising and lowering the bobbin 8 inside the shuttle 2, and a shuttle handling finger 29 for moving the shuttle 2 by attaching to a flat surface formed at a longitudinal end of the shuttle 2. The shape of the hook 28 is not limited to be annular, but may also take other forms such as the shape of letter C as long as it allows the hook to be engaged with a head portion of the bobbin 8.

The shuttle handling finger 29 comprises a rod 29*a* which is longitudinally moveably supported on a main part of the third hand 14, a funnel-shaped suction pad 29*b* fixedly attached to a free end of the rod 29*a*, and a compression coil spring 29*c* for urging the rod 29*a* in outward direction. The rod 29*a* and the suction pad 29*b* are provided with an axial bore 29*d* which is passed through from a base end of the rod 29*a* to the suction pad 29*b*, and opens out at a concave bottom surface of the suction pad 29*b*. The base end of the rod 29*a* is provided with a hose nipple 29*e* communicating with the axial bore 29*d* so that The axial bore 29*d* may be depressurized by connecting a hose leading to a suction pump not shown in the drawing to this hose nipple 29*e*.

These hands 12 to 14 having the above described structure are separately supported by the hand stand 15 when not in use. For instance, with regard to the first hand 12, a support slot 12*a* is formed at a base end of this hand as shown in FIG. 2, and this hand is supported on the hand stand 15 in a stand-by condition by fitting a horizontal tongue extending from the hand into this slot 12*a*. The other hands 13 and 14 have a similar structure, and the description thereof is omitted. It is also possible to place the hand stand 15 between the base of the robot 9 and the welding machine 18, and adapt the three hands 12 to 14 to be removed and mounted along vertical direction.

The bobbin holding cap 22 of the first hand 12 is provided on the free end of the rod 22*b* which is axially moveably carried by the first hand 12, and is additionally provided with a position sensor 30 at an appropriate location for detecting the retracted condition of the rod 22*b* with the bobbin holding cap 22 fitted on a head portion of the bobbin 8 clamped by the first hand 12. This allows to detect whether the bobbin 8 has been clamped or not. The second hand 13 is also provided with a similar position sensor (not shown in the drawing).

This device is provided with a slack preventing unit 31 for preventing the weft 4 extending from the shuttle 2 and the ground fabric as it is paid out from the shuttle 2 from slacking. This slack preventing unit 31 consists of a fixed ring located above the part of the weft 4 extending between the shuttle 2 at the cop replacing position and the warp 3, and a moveable hand which can pass through the fixed ring along a longitudinal direction of itself, and can grip the weft 4. This moveable hand is provided with a hand opening/closing actuator, and can be actuated by an air cylinder into a reciprocating motion along the vertical direction. For more details of the slack preventing unit 31, reference should be made to the disclosure of U.S. Pat. No. 5,016,677.

In this device, the properly positioned shuttle 2 and other parts of the device are located within the range of movement of the arm 11 of the robot 9. The various parts of the device are automatically operated according to a work flow programmed in a control unit not shown in the drawings. As sensors needed for this automatic operation, an optical sensor is employed for detecting the amount of the weft 4 remaining in the shuttle 2, and limit switches are arranged in appropriate places to detect any breakage of the weft 4.

Some of the details of this cop replacing device and the weaving machine are not descried in this specification, and reference should be made to the disclosure of U.S. Pat. No. 5,016,677 for such details.

The operation of the cop replacing device for a weaving machine having the above described structure is now described in the following.

First of all, the first hand 12 is attached to the robot arm 11. This can be accomplished by moving the robot arm 11 to the hand stand 15, and coupling the two coupling halves provided on the hand 12 and the free end of the arm. Once the first hand 12 is coupled to the robot arm 11, the hand can be removed from the hand stand 15 by sliding it off the tongue piece of the hand stand 15 which has been supporting the first hand 12. Then, the new weft 23 is pulled out from the new cop 17 stored in the cop stocker 16, and is moved to a prescribed position by gripping it with the new weft gripping fingers 24 of the first hand 12. While the new weft 23 is thus gripped, the head portion of the new cop 17 is clamped by the bobbin clamping fingers 21, and the new cop 17 is placed in an upright condition by being fitted into a cop receiving cup 19*a* of the new cop stand 19. The new cop 17 thus supported by the new cop stand 19 is held rotatable by a bobbin head holder 19*b* of the new cop stand 19.

This cop stocker 16 contains four cartridges each containing five cops in a single row, and the cops can be placed therein by each cartridge. For instance, the first two cartridges and the second two cartridges may contain two different kinds of cops having different kinds of weft around them. The robot 9 is initially taught to pick up the new cops 17 from the cop stocker 16 in a prescribed order.

The new weft 23 which has been gripped by the first hand 12 as described above is then drawn out from the cop 17 supported upright in the new cop stand 19, and is passed across a pair of positioning pins 32 of the welding machine 18 in a crisscross fashion. The pulled out new weft 23 is gripped by a pair of new weft gripping chucks 33 arranged on either side of the positioning pins 32.

The first hand 12 is then returned to the prescribed position in the hand stand 15, and the third hand 14 is attached to the robot arm 11 in the same way as the first hand 12. When the shuttle 2 has flown across the warps a prescribed number of times and the weft 4 has been consumed by more than a prescribed amount, the shuttle 2 is held stationary in the shuttle box 1. The suction pad 29*b* of the shuttle handling finger 29 is then pushed against the outer end surface of the stationary shuttle 2, and after securing the suction pad 29*b* to the end surface by depressurizing the interior of the suction pad 29*b* the shuttle 2 is pulled out to the cop replacing position as indicated by the solid lines in FIG. 1. The shuttle 2 is then positioned in a stable fashion by securing the end of the shuttle remote from the suction pad 29*b* or the two longitudinal ends of the shuttle 2 by using an air cylinder. The hook 28 of the third hand 14 is fitted on the head portion of the bobbin 8 which is laid flat in the shuttle 2, and the old cop 7 is raised by pulling the hook 28 upward along an arcuate path.

The second hand 13 is then attached to the robot arm 11 in place of the third hand 14 which been attached to the robot arm 11, and while a part of the weft 4 extending between the eye of the shuttle 2 and the raised old cop 7 is gripped by the old weft gripping fingers 27 the head portion of the bobbin 8 in the old shuttle 2 is clamped by the bobbin clamping fingers 25. The old weft gripping fingers 27 can be rotated by 90 degrees between the positions indicated by the imaginary lines and the solid lines in FIG. 4, and can be placed at a desired position depending on each particular work step. The bobbin 8 of the old cop 7 is removed from the tong 6, and the old cop 7 is placed in the old cop stand 20. The old cop stand 20 is similarly constructed as the new cop stand 19, and consists of a cop receiving cup 20*a* and a bobbin head holder 20*b* so as to hold the old cop 7 in the upright condition.

The old weft 4 drawn from the old cop 7 placed upright on the old cop stand 20 is gripped and pulled out of the old cop 7 by the old weft gripping fingers 27, and is passed between the pair of positioning pins 32 of the welding machine 18 so as to crisscross the new weft 23, and is placed in position by being gripped by the old weft gripping chucks 34 located on either end of the positioning pins 32. Because the tension of the weft 4 is relatively small when passing the weft 4 across the positioning pins 32, there is a possibility that the old weft 4 may slack at the final point of passing the weft 4 across the positioning pins 32. Therefore, the moveable hand of the slack preventing device 31 is elevated by a certain amount before passing the old weft across the positioning pins 32 so as to apply a certain amount of tension to the old weft 4.

The three points of intersection between the old weft 4 and the new weft 23 are welded and coupled by lowering a welding horn placed above the positioning pins 32 of the welding machine although it is not shown in the drawings, and clamping the points to be welded between the welding horn and an anvil. Upon completion of the welding of the two wefts, the unnecessary portions of the old weft 4 and the new weft 23 are trimmed by weft shears arranged on either side of the positioning pins 32, and the old weft 4 and the new weft are integrally joined together.

Upon completion of the coupling of the wefts, the cop receiving cup 20*a* of the old cop stand 20 is tilted, and the old cop 7 is ejected to a recovery box not shown in the drawings by way of a cop ejecting chute 35 provided in a portion toward which the cop receiving cup 7 was tilted.

With the second hand 13 still mounted on the robot arm 11, the new cop 17 is clamped by the bobbin clamping finger 25, and is carried thereby to the shuttle 2. The new cop 17 is then fitted onto the tong 6. At this point, a force sensor 36 for instance consisting of a strain gage provided on a suitable location of the robot arm 11 detects a stress produced in the robot arm 11 when the bottom surface of the bobbin 8 of the new cop 17 strikes the tong 6 for the purpose of detecting a failure to properly fit the bobbin 8 onto the tong 6. When a failure to properly fit the bobbin 8 onto the tong 6 has occurred, new attempts will be made by slightly changing the position of the robot arm 11 up to a certain number of times.

Upon completion of fitting the new cop 17 onto the tong 6, the third hand 14 is attached to the robot arm 11 in place of the previously used second hand, and the hook 28 of the third hand 14 is fitted onto a head portion of the bobbin 8 of the new cop 17, and tilts the new cop 17 down into the slot of the shuttle 2. The shuttle 2 is then returned from the cop replacing position back into the shuttle box 1 by the shuttle handling finger 29 while the braking device of the shuttle box 1 is released. Thereafter, the shuttle 2 is shot out, and the weaving process is resumed.

Thus, according to the present invention, in an automatic weaving machine for carrying out the process of weaving while the old cop from which the weft is consumed by more than a prescribed amount is changed to a new cop from time to time, because a series of work steps involved in replacing the cop can be carried out by a single robot by changing the hand for each different work step, the work of replacing the cop can be carried out in an optimum fashion by selecting an optimum hand for each different work step. It is therefore not necessary to carry a number of hands on a single robot arm all at the same time.

In particular, the hand for clamping the head portion of the bobbin when replacing the cop comprises fingers for radially inwardly clamping the bobbin and a bobbin head holding finger, the bobbin would not wobble when the cop is being transferred by the robot, and the cop can be handled at a high precision so that the robot may carry out highly sophisticated movements. Also, by providing a suction pad to the hand for engaging the shuttle by vacuum suction, the shuttle can be transferred by the robot, and the overall system can be simplified because no additional structure is required for transferring the shuttle.

By using different hands for handling the old weft and the new weft, and setting the weft gripping force of the old weft handling hand to be less than that of the new weft handling hand, the old weft can be slipped through the hand when the old weft is being drawn from the old cop to the weft tying device, and the possibility of damaging the old weft can be eliminated. Additionally, because the gripping force of the new weft handling hand can be made sufficiently large, pulling of the new weft from the new cop can be carried out in a highly reliable fashion.

Although the present invention has been described in terms of a specific embodiment thereof, it is possible to modify and alter details thereof without departing from the spirit of the present invention.

What we claim is:

1. A cop changing device for a weaving machine in which a shuttle, carrying a cop consisting of a bobbin around which weft is wound, is reciprocated between shuttle boxes at opposite ends of warps so as to weave said weft between said warps, said cop changing device comprising:

a base for positioning adjacent a shuttle box having a shuttle retention means for selectively retaining a shuttle with a cop;

a new cop stand, an old cop stand, and a hand stand mounted on said base;

a robot positioned on said base for being in spaced-apart relationship with said shuttle box, said new cop stand, said old cop stand, and said hand stand;

a plurality of hands positioned on said hand stand, said hands adapted to be interchangeably and selectively mounted on said robot, said plurality of hands including at least one cop hand having bobbin fingers and weft fingers for positioning cops and wefts, and a shuttle hand having a shuttle finger for positioning the shuttle and a hook for raising and lowering the cops from the shuttle;

weft tying means mounted on said base for tying an old weft from an old cop mounted on the old cop stand with a new weft from a new cop mounted on the new cop stand to form a continuous weft; and a control means in communication with the shuttle box, said robot, and said weft tying means for controlling the operations in changing cops and tying wefts.

2. The cop changing device according to claim 1, wherein the cop hand includes a pair of bobbin fingers and a bobbin cap for gripping a bobbin of the cop, and a pair of new gripping fingers for gripping the new weft.

3. The cop changing device according to claim 1, wherein said plurality of hands includes two cop hands, a new cop hand for positioning new cops and new weft on the new cop stand, and an old cop hand for transferring old cops and old weft from the shuttle to the old cop stand and for transferring new cops and weft from the new cop stand to the shuttle.

4. The cop changing device according to claim 3, including an actuating means connected to the new cop hand for applying a new gripping force and to the old cop hand for applying an old gripping force, wherein the new gripping force of the new cop hand is greater than the old gripping force of the old cop hand.

5. The cop changing device according to claim 1, wherein the shuttle finger of the shuttle hand includes a suction pad for moving the shuttle from and to the shuttle box.

6. The cop changing device according to claim 1, wherein the hook on the shuttle hand includes a substantially annular member for pivoting a cop mounting tong in the shuttle.

7. The cop changing device according to claim 1, wherein each of said plurality of hands includes a mounting slot and said mounting stand includes a plurality of tongues for retaining said hands in the desired position for mounting on said robot.

8. The cop changing device according to claim 1, including a force sensor mounted on said robot and connected to said control means for detecting the proper positioning of the new cop in the shuttle.

9. The cop changing device according to claim 1, wherein said old cop stand and said new cop stand include a cup shaped support for a bottom end of the cop and a bobbin head holder for an upper end of the cop to facilitate the free rotation of cops mounted on said stands.

10. The cop changing device according to claim 1, including a cop stocker positioned adjacent said base for supplying new cops, said stocker including a plurality of support pins for supporting the new cops.

11. The cop changing device according to claim 1, wherein said weft tying means includes a welding machine.

12. The cop changing device according to claim 1, including a weft trimming means for trimming an extraneous part from the continuous weft.

13. The cop changing device according to claim 1, wherein the cop hand includes a position sensor connected to said control system for detecting proper clamping of the cops.

14. The cop changing device according to claim 1, including an ejection means formed on said old cop stand for removing the old cop from said old cop stand after the continuous weft has been tied.

15. A cop changing device for a weaving machine in which a shuttle, carrying a cop consisting of a bobbin around which weft is wound, is reciprocated between shuttle boxes at opposite ends of warps so as to weave said weft between said warps, said cop changing device comprising:

a base for positioning adjacent a shuttle box having a shuttle retention means for selectively retaining a shuttle, said shuttle including a cop mounted on a tong pivotally attached to said shuttle;

a new cop stand, an old cop stand, and a hand stand mounted on said base;

a robot positioned on said base for being in spaced-apart relationship with said shuttle box, said new cop stand, said old cop stand, and said hand stand;

a plurality of hands positioned on said hand stand, said hands adapted to be interchangeably and selectively mounted on said robot, said plurality of hands including at least one cop hand having bobbin fingers and weft fingers for positioning cops and wefts, and a shuttle hand having a shuttle finger for positioning the shuttle and a hook for pivotally raising and lowering cops mounted on the tong in the shuttle;

weft tying means mounted on said base for tying an old weft from an old cop mounted on the old cop stand with a new weft from a new cop mounted on the new cop stand to form a continuous weft;

a force sensor mounted on said robot for measuring force when a cop is properly positioned on the tong of said shuttle; and a control means in communication with the shuttle box, said robot, said weft tying means and said force sensor for controlling the operations in changing cops and tying wefts.

* * * * *